United States Patent [19]

Garrone

[11] 4,417,594

[45] Nov. 29, 1983

[54] APPARATUS FORMING A CONTINUOUS CUT TOBACCO BRAID IN A CIGARETTE MAKING MACHINE

[75] Inventor: Franco Garrone, Bologna, Italy

[73] Assignee: Sasib S.p.A., Bologna, Italy

[21] Appl. No.: 322,725

[22] Filed: Nov. 18, 1981

[30] Foreign Application Priority Data

Nov. 21, 1980 [JP] Japan ..... 12731 A/80

[51] Int. Cl.[3] ..... A24C 5/14; A24C 5/39

[52] U.S. Cl. ..... 131/110; 131/84 R; 131/84 B; 131/84 C

[58] Field of Search ..... 131/109 B, 84 R, 84 A, 131/84 B, 84 C, 108, 110

[56] References Cited

U.S. PATENT DOCUMENTS

| | | | |
|---|---|---|---|
| 3,092,117 | 6/1963 | Labbe | 131/84 B |
| 3,282,270 | 11/1966 | Morris et al. | 131/84 B |
| 3,549,293 | 12/1970 | Wilde et al. | 131/84 B |
| 3,949,763 | 4/1976 | Labbe et al. | 131/84 B |
| 4,024,878 | 5/1977 | Labbe | 131/84 B |
| 4,055,192 | 10/1977 | Berlin et al. | 131/84 B |
| 4,155,367 | 5/1979 | Rudszinat et al. | 131/84 B |

FOREIGN PATENT DOCUMENTS 1340201 12/1973 United Kingdom ..... 131/84 B

*Primary Examiner*—V. Millin

*Attorney, Agent, or Firm*—Spencer & Frank

[57] ABSTRACT

An apparatus for making a continuous cut tobacco braid in a cigarette making machine. A transfer duct transfers the cut tobacco in an air stream from the cut tobacco feeder to an endless braid-forming suction tape, and a pneumatic collecting duct which receives the greater and heavier tobacco particles and conveys them into a collecting box. A second pneumatic collecting duct receives the excess tobacco trimmed from the tobacco braid being formed and conveys it into a feeding hopper. A deflector valve between the two pneumatic ducts is switchable between two positions, in one of which the tobacco ribs are conveyed through the first-mentioned duct into the collecting box and the trimmed excess tobacco is conveyed through the second duct to the feeding hopper. In the second position, the deflector valve causes the cut tobacco, including the tobacco ribs, to be returned into the feeding hopper. A sensor is arranged within the transfer duct and, with the help of a control circuit, switches the deflector valve so as to assure proper operation of the apparatus.

3 Claims, 4 Drawing Figures

APPARATUS FORMING A CONTINUOUS CUT TOBACCO BRAID IN A CIGARETTE MAKING MACHINE

SUMMARY OF THE INVENTION

The present invention relates to an apparatus for forming a continuous cut tobacco braid in a cigarette making machine. Usually, an apparatus of this type comprises a cut tobacco delivery front, which supplies the cut tobacco to an ascending transfer duct which conveys the tobacco, entrained in an ascending stream of air, to the underside of an endless suction tape, where the tobacco braid is formed. After the formation of the tobacco braid, which contains tobacco in excess, the said tobacco braid is subjected to the action of a trimmer device, which trims off the said excess tobacco. The trimmed excess tobacco is then recycled to the tobacco hopper, which feeds the delivery front.

In apparatuses of the described type, there exists the possibility of formation, in the upwardly directed transfer duct, of obstructions of cut tobacco, which may cause congestions and jammings in the transfer duct, with consequent disturbances in the operation of the cigarette making machine.

In order to timely stop the apparatus and remove said obstructions before they completely jam the transfer duct, the invention proposes an automatic device which comprises a sensor arranged in the said transfer duct, in a zone in which it is most probable the formation of a cut tobacco obstruction, the said sensor being sensitive to the initial formation of an obstruction in such a manner as to stop the cigarette making machine, and also to stop the stream of air in the transfer duct, while at the same time it puts into operation a pneumatic duct which recycles into the tobacco feeder the cut tobacco which continues to be fed to the transfer duct, during the time which is requested by the cigarette making machine for its complete stopping (which is not instantaneous). In this manner, the cut tobacco obstruction in the transfer duct is timely detected, stopped and can be easily removed, thus limiting the stopping time of the cigarette making machine.

The above and other features of the invention, and the advantages deriving therefrom, will appear evident from the following detailed description of a preferred embodiment, made by way of non-limiting example, with reference to the attached drawings.

DESCRIPTION OF THE PREFERRED EMBODIMENT

Figure 2:
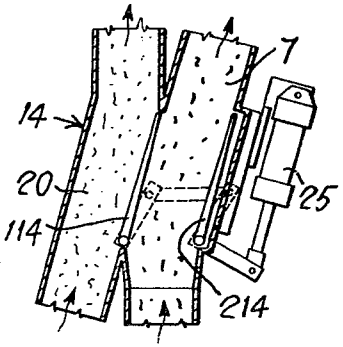
FIG. 2 shows in section, in an enlarged scale, a detail of the deflector valve employed in the apparatus according to the invention.

With reference to the drawings, the pneumatic transfer duct comprises, for example, a T-shaped duct of the type illustrated in the U.S. Pat. No. 4,041,959 (Garrone). The said T-shaped duct 1 provides to the transfer of the cut tobacco from the delivery end (which is transversal to the working line of the cigarette making machine) of the belt 2 of the cut tobacco feeder 3 (which usually comprises a carding drum 4), to the endless belt braid-forming suction tape 5 of the tobacco braid and tobacco rod forming line 6 of the cigarette making machine. At the interior of the said T-shaped duct 1 there is created and maintained an ascending air stream the flow of which is suitably adjusted, in such a manner as to entrain upwardly the cut tobacco delivered from belt 2, while the greater and heavier tobacco parts, such as the ribs 7, are separated from the cut tobacco due to their impact against the angle plate 8 (see FIG. 1). In the normal operation of the cigarette making machine, the said tobacco ribs 7 fall inside a trough 9, from which they are conveyed to the suction manifold 10 through star valve 11. From the manifold 10 the said ribs 7 are engaged and carried by the air stream existing at the interior of the suction duct 12, 112 and are discharged from the said duct (under normal operational conditions of the machine) into the pneumatic collecting box 13, by passing through the deflector valve 14 in its "straight" position, as illustrated in FIG. 2.

At the interior of the T-shaped duct 1 there is created and maintained an ascending stream of air due to the combined suction exerted through the suitable grid 15 at the top of the duct itself (see FIG. 3) by the suction manifold 16 controlled through the throttle valve 17, and due to the suction exerted through the permeable tape 5.

The cut tobacco, as above mentioned, is engaged and carried by the said ascending air stream and is caused to be deposited on the underside of the suction tape 5 which closes the hood 18 at the top of the said T-shaped duct 1. The thus deposited cut tobacco forms a uniform layer 19 of a predetermined thickness, presenting a predetermined exceeding non uniform portion 20. The said exceeding portion 20 is trimmed off by the rotary trimmers 21 and the discard or excess tobacco (i.e. the tobacco removed by the trimmers) is sucked by the suction duct 22, 122 which recycles it to the hopper 103 of the tobacco feeder 3. More particularly, the pneumatic duct 22, 122 discharges the excess tobacco inside the plenum chamber 23 from which chamber the said excess tobacco falls into the said hopper 3 through the star valve 24.

The suction ducts 12, 112 and 22, 122 are operatively associated between each other by means of the deflector valve 14, comprising the paired switch flaps 114, 214 which are controlled at will, for example by a double-acting pneumatic cylinder 25. Under normal conditions of operation of the cigarette making machine, the deflector 14 is positioned in the not-commutated position illustrated in FIG. 2, in which both ducts 12, 112 and 22, 122 are under suction and the duct 12, 112 discharges the tobacco ribs into the pneumatic box 13, while the duct 22, 122 conveys the excess tobacco 20 back to the hopper 103 of the tobacco feeder 3.

During the said normal conditions of operation, at the interior of the pneumatic transfer duct 1 there may be formed progressively cut tobacco obstructions which, whenever they are left free to grow so as to cause a jamming of the said transfer duct, will cause long stops of the machine for their removal.

Usually, in a transfer duct 1 of the type illustrated, these obstructions tend to be formed in the zone indicated by the reference numeral 26 corresponding to the downstream end of the stem of the T-shaped duct, just below the suction tape 5.

Figure 3:
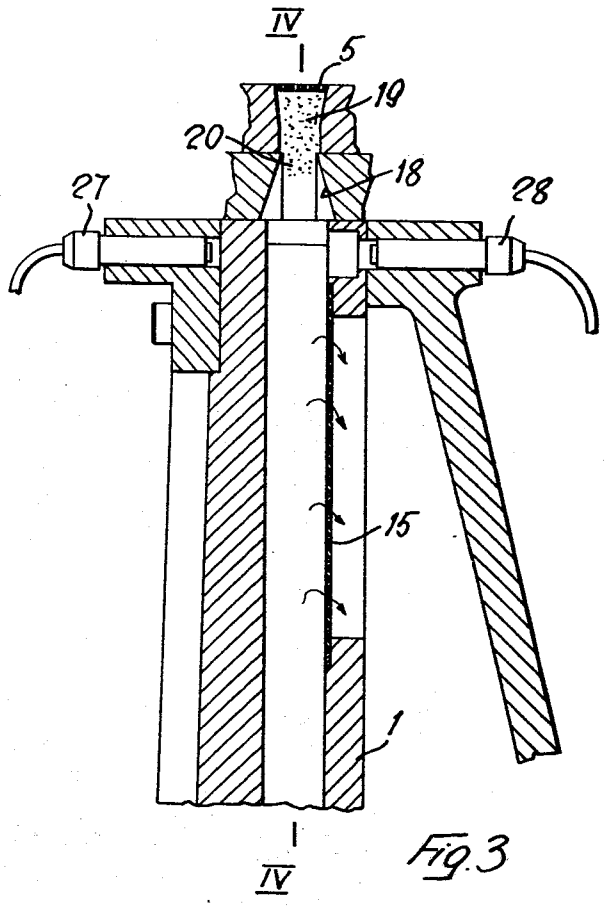
FIG. 3 is a section, in an enlarged scale, according to lines III—III of FIG. 1, and shows a detail relating to the photocell type sensor used for detecting the cut tobacco obstructions in the transfer duct.
Figure 4:
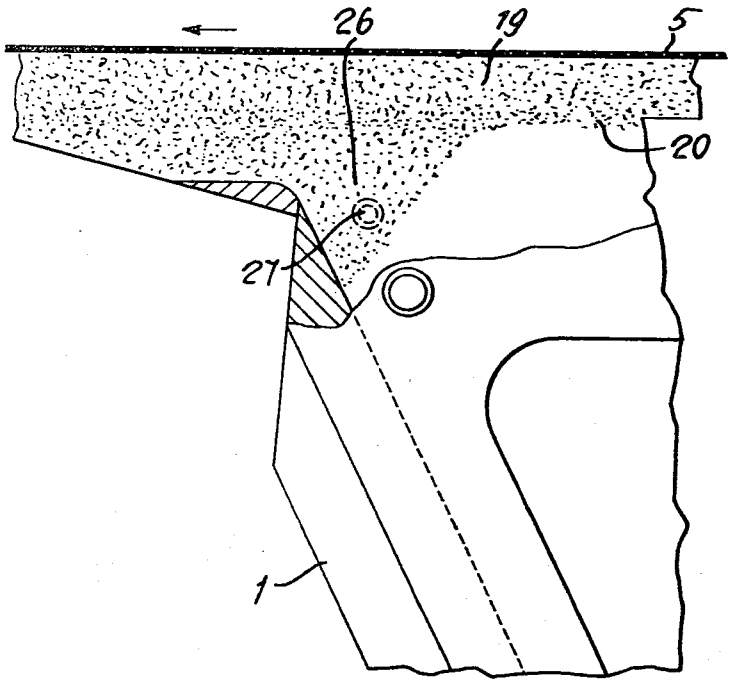
FIG. 4 is a section according to line IV—IV of FIG. 3.

In order to avoid such inconveniences, in the zone 26 of initial formation of the tobacco obstruction, there is arranged a sensor device, preferably of the photoelectric type, such as for example a photocell 27 and a light emitting source 28, arranged repsectively at each side of the transfer duct 1 (see particularly FIG. 3).

Figure 1:
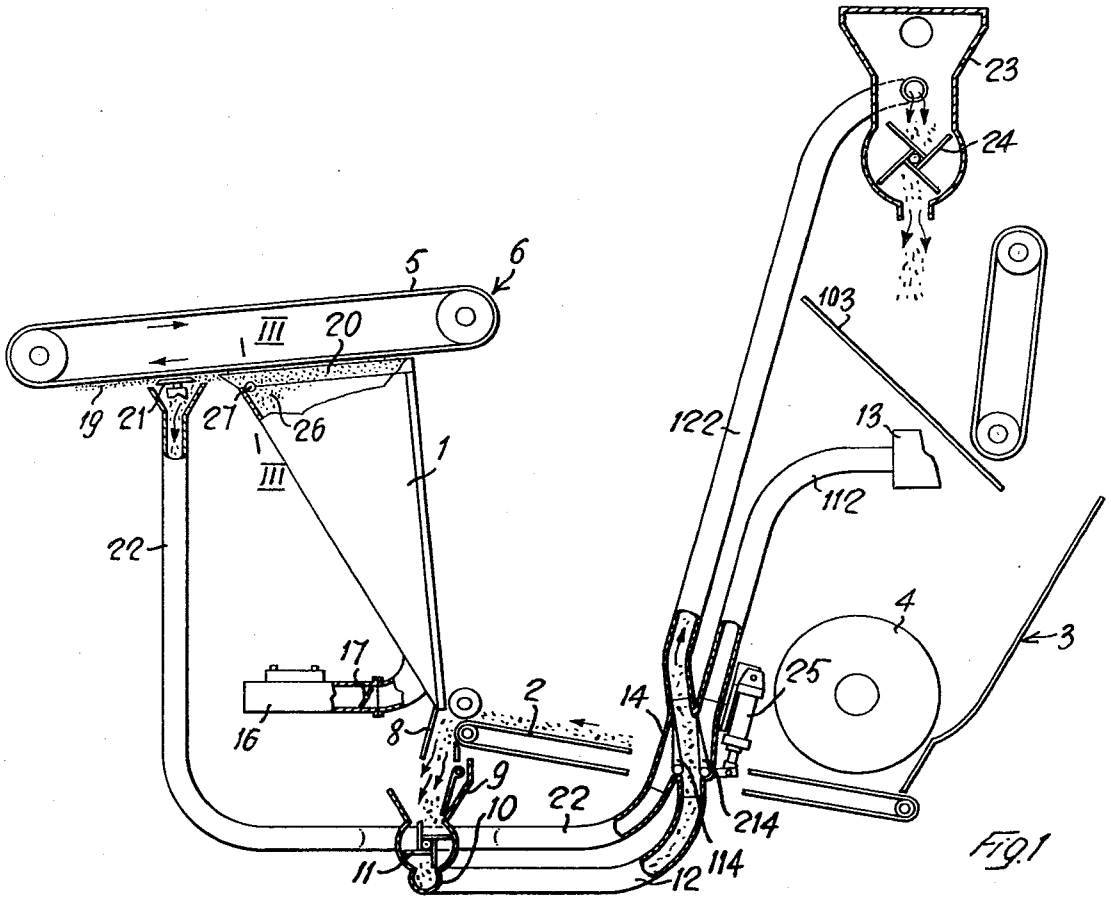
FIG. 1 is a diagrammatic side elevation view which shows a transfer duct for transferring the cut tobacco from the delivery end of a tobacco feeder to the suction tape of the tobacco braid forming line, said transfer duct being provided with a device for detecting and stopping the formation of tobacco obstructions at its interior.

The photoelectric cell 27 is mounted in a conventional control circuit (not illustrated) which controls, with time delay (if necessary), the closure of the throttle valve 17 and the switching of the deflector valve 14 from its normal position (FIG. 2) to the commutated position shown in FIG. 1, in which there is stopped the suction in the descending duct 22 while the trimmers 21 are also stopped together with the cigarette making machine, following to the operation of the control circuit. The suction is also stopped in the branch duct 122 leading to the pneumatic box 13 which receives the tobacco ribs, while a suction stream is established through the ducts 12 and 122 so as to convey back into the hopper 103 all the cut tobacco which is discharged by the delivery belt 2 still for a certain time period after the stopping of the ascending suction stream through the T-shaped duct 1, in consideration of the fact that the stopping of the cigarette making machine is not istantaneous.

Due to the fact that the tape 5, although stopped, is maintained under suction, the gravity force will not be sufficient by itself for causing the downfall of the occlusion 26, so that said occlusion will have to be removed manually. However, in consideration of the fact that the device according to the invention detects and stops at their very starting the obstructions, the occlusion produced by them is very limited and can be removed in a short time. Thereafter, the cigarette making machine can be again started, after having opened the throttle valve 17 and switched the deflector valve 14 to the normal position shown in FIG. 2.

It is believed that the invention will have been clearly understood from the foregoing detailed description of a preferred embodiment. Changes in the details of construction may be resorted to without departing from the spirit of the invention, and it is accordingly intended that no limitation be implied and that the hereto annexed claims be given the broadest interpretation to which the employed language fairly admits.

I Claim:

1. Apparatus for forming a continous cut tobacco braid in a cigarette making machine, comprising:

a transfer duct (1) for transferring by means of a suitable air stream the cut tobacco from the delivery end of a cut tobacco feeder (2, 3) to an endless braid-forming suction tape (5);

a first pneumatic collecting duct (12, 112) which receives the greater and heavier tobacco particles, such as tobacco ribs, from the said delivery end of the said tobacco feeder, and conveys them into a collecting box (13);

a second pneumatic collecting duct (22, 122) which receives the excess tobacco trimmed from the tobacco braid being formed on the underside of the said braid-forming suction tape (5) by suitable trimmers (21) arranged along the path of the said suction tape (5) dowstream of the said transfer duct (1), for conveying said trimmed excess tobacco into the feeding hopper (103) of said cut tobacco feeder (2, 3);

a deflector valve (14) arranged between the said first pneumatic duct (12, 112) for the tobacco ribs and the said second pneumatic duct (22, 122) for the trimmed excess tobacco, said deflector valve (14) being switchable from a first position in which the tobacco ribs are conveyed through the first pneumatic duct from the delivery end of the tobacco feeder into the collecting box, and the trimmed excess tobacco is conveyed through the second pneumatic duct from the trimmers to the feeding hopper of the cut tobacco feeder, to a second position in which the cut tobacco delivered by the delivery end of the cut tobacco feeder, including the tobacco ribs, is returned into the feeding hopper (103) of the cut tobacco feeder, while the suction is stopped in the duct (22) receiving the trimmed excess tobacco, and the suction is also stopped in the duct (112) leading to the tobacco ribs collecting box (13);

sensor means (27, 28) arranged at the interior of the tobacco transfer duct (1) said sensor means being sensitive to the formation of tobacco obstructions or concentrations at the interior of the said transfer duct (1), said sensor means being operatively associated with a control circuit for actuating control means for switching the said deflector valve (14) and for interrupting the air stream at the interior of the transfer duct (1).

2. Apparatus according to claim 1, in which the sensor means comprises a light emitting source (28) arranged on one side of the cut tobacco transfer duct (1) and a cooperating photoelectric cell (27) arranged on the other side of the said transfer duct.

3. Apparatus according to claim 1, in which the said deflector valve is operated by means of a double-acting pneumatic piston and cylinder unit.

* * * * *

UNITED STATES PATENT AND TRADEMARK OFFICE

CERTIFICATE OF CORRECTION

PATENT NO. : 4,417,594

DATED : 11-29-83

INVENTOR(S) : Franco Garrone

It is certified that error appears in the above-identified patent and that said Letters Patent is hereby corrected as shown below:

On the title page under Item (30) Foreign Application Data,

"Nov. 21, 1980 (JP) Japan 12731 A/80"

should read

--Nov. 21, 1980 (IT) Italy 12731 A/80 --.

Signed and Sealed this

*Third* Day of *July 1984*

[SEAL]

*Attest:*

GERALD J. MOSSINGHOFF

*Attesting Officer*

*Commissioner of Patents and Trademarks*